US006907746B2

(12) United States Patent
Sato et al.

(10) Patent No.: US 6,907,746 B2
(45) Date of Patent: Jun. 21, 2005

(54) MULTISTAGE COMPRESSION TYPE ROTARY COMPRESSOR AND COOLING DEVICE

(75) Inventors: Kazuya Sato, Oizumi-machi (JP); Kenzo Matsumoto, Oizumi-machi (JP); Haruhisa Yamasaki, Oizumi-machi (JP); Akifumi Tomiuka, Isesaki (JP); Kazuaki Fujiwara, Ota (JP); Kentaro Yamaguchi, Oizumi-machi (JP); Masaji Yamanaka, Tatebayashi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/703,261

(22) Filed: Nov. 6, 2003

(65) Prior Publication Data

US 2004/0118147 A1 Jun. 24, 2004

(30) Foreign Application Priority Data

Nov. 7, 2002 (JP) ..... 2002-323244
Nov. 22, 2002 (JP) ..... 2002-339375

(51) Int. Cl.[7] ..... F25B 7/00

(52) U.S. Cl. ..... 62/175; 62/498; 62/510; 417/247; 417/250

(58) Field of Search ..... 62/510, 175, 498; 417/245, 246, 247, 250, 352, 355, 405

(56) References Cited

U.S. PATENT DOCUMENTS 5,152,156 A * 10/1992 Tokairin ..... 62/498
6,189,335 B1 * 2/2001 Ebara et al. ..... 62/510
6,732,542 B2 * 5/2004 Yamasaki et al. ..... 62/278
6,748,754 B2 * 6/2004 Matsumoto et al. ..... 62/175
2004/0040339 A1 * 3/2004 Matsumoto et al. ..... 62/470
2004/0151603 A1 * 8/2004 Tadano et al. ..... 417/312
2004/0211216 A1 * 10/2004 Yamasaki et al. ..... 62/498
2004/0216484 A1 * 11/2004 Yamasaki et al. ..... 62/510

FOREIGN PATENT DOCUMENTS

EP 1 195 526 4/2002
EP 1 209 361 5/2002
EP 1 369 590 12/2003

* cited by examiner

*Primary Examiner*—Marc Norman
(74) *Attorney, Agent, or Firm*—J.C. Patents

(57) ABSTRACT

A multi-stage compression type rotary compressor, having a driving element and a first and a second rotary compression element that are driven by the driving element in a sealed container, is provided. The refrigerant compressed by the first rotary compression element is discharged into the sealed container, and said discharged refrigerant with an intermediate pressure is then compressed by the second rotary compression element. By cooling the refrigerant absorbed into the second rotary compression element, the rise in the temperature of the refrigerant that is compressed and discharged by the second rotary compression element can be suppressed. And, the supercooling degree of the refrigerant is increases before reaching the expansion valve to improve the cooling ability of the evaporator.

2 Claims, 5 Drawing Sheets

MULTISTAGE COMPRESSION TYPE ROTARY COMPRESSOR AND COOLING DEVICE

CROSS-REFERENCE TO RELATED APPLICATION

This application claims the priority benefit of Japanese application serial nos. 2002-323244, filed on Nov. 7, 2002 and 2002-339375, filed on Nov. 22, 2002.

BACKGROUND OF THE INVENTION

1. Field of the Invention

This invention generally relates to a multistage compression type rotary compressor, wherein a driving element and a first and a second rotary compression elements both driven by the driving element are arranged in a sealed container, and a refrigerant compressed by the first rotary compression element is discharged into the sealed container and the discharged intermediate pressure refrigerant is further compressed by the second rotary compression element. In addition, the present invention relates to a cooling device, in which a compressor, a gas cooler, a throttling means and an evaporator are connected in series.

2. Description of Related Art

Conventionally, in a multistage compression type rotary compressor, especially, in an internal intermediate pressure multiage (two stages) compression type rotary compressor, refrigerant gas is absorbed from an absorption port of the first rotary compression element arranged at the lower side to a low pressure chamber side of a lower cylinder. The refrigerant gas is thus compressed to possess an intermediate pressure due to an operation of roller and valve, and then discharged from a high pressure chamber side of an upper cylinder, through a discharging port and a discharging muffler chamber, and then into the sealed container. Thereafter, the intermediate pressure refrigerant gas in the sealed container is absorbed from an absorption port of the second rotary compression element arranged at the upper side into a low pressure chamber side in an upper cylinder. By an operation of roller and valve, the intermediate pressure refrigerant gas becomes high temperature and high pressure refrigerant gas. Then, the high temperature and high pressure refrigerant gas flows from the high pressure chamber side, through a discharging port and a discharging muffler chamber, and then to a radiator, at which a heat radiation is effectuated. After the heat radiation is effectuated, the refrigerant gas is throttled by an expansion valve and absorbs heat at the evaporator. Then, the refrigerant gas is absorbed into the first rotary compression element. The aforementioned refrigerant cycle is repeatedly conducted.

In the above rotary compressor, when refrigerant with a high difference between its high and low pressures is used, e.g., using carbon oxide ($CO_2$) as refrigerant, the refrigerant pressure is 8 MPaG (intermediate pressure) at the first rotary compression element (as a lower side), and is a high pressure of 12 MPaG at the second rotary compression element (as a higher side).

As the carbon dioxide is compared with the conventional freon refrigerant, because of a high gas density, a sufficient freezing capability can be obtained even though the volume flow of the refrigerant is small. In other words, if the compressor possesses an ordinary ability, it is possible to reduce its displacement volume. But, in that case, since reduction in the inner diameter of the cylinder will cause a reduction of the compression efficiency, the thickness of the cylinder is made smaller and smaller.

However, as thinning the thickness of the cylinder, since refrigerant introduction pipes for introducing the refrigerant cannot be connected to the absorption side of each cylinder, and conventionally, the refrigerant introduction pipes are connected to an upper supporting member and a lower supporting member both of which are used to block an opening at the upper side of the upper cylinder and an opening at the lower side of the lower cylinder, as well as used as bearings of a rotational shaft. In this way, the refrigerant is introduced into each cylinder through each supporting member (referring to pages 7 and 8 of Japanese Laid Open Publication No. 2001-82369).

Furthermore, in a conventional cooling device, a rotary compressor (compressor), a gas cooler, a throttling means (an expansion valve, etc.) and an evaporator are sequentially and circularly connected in series with pipes so as to form a refrigerant cycle (a refrigerant circuit). The refrigerant gas is absorbed from an absorption port of a rotary compression element of the rotary compressor into a low pressure chamber side of a cylinder. By an operation of roller and valve, the refrigerant gas is compressed to form a high temperature and high pressure refrigerant gas. Then, the high temperature and high pressure refrigerant gas is discharged from a high pressure chamber side, through a discharging port and a discharging muffler chamber, and then to the gas cooler. After the refrigerant gas radiates heat at the gas cooler, the refrigerant gas is throttled by the throttling means, and then supplied to the evaporator where the refrigerant gas evaporates. At this time, the refrigerant gas absorbs heat from the ambient to effectuate a cooling effect.

In addition, for addressing the global environment issues in recent years, such cooling device does not use the Freon type refrigerant, and a cooling device for the refrigerant cycle, in which a nature refrigerant (e.g., carbon oxide, $CO_2$) is used as the refrigerant, is developed.

In such a cooling device, in order to prevent the liquid refrigerant from returning back to the compressor to cause a liquid compression, an accumulator is arranged between an outlet side of the evaporator and an absorption side of the compressor. The cooling device is thus constructed in a structure where the liquid refrigerant is accumulated in the accumulator and only the gas refrigerant is absorbed into the compressor. The throttling means is adjusted in a manner so that the liquid refrigerant in the accumulator does not return back to the compressor (referring to Japanese Publication No. H07-18602).

However, in a case that the compressor has a larger capability than above, a cylinder with a thick dimension can also be used to connect the refrigerant pipes. Therefore, different from the above case, the refrigerant introduction pipes can be connected to the upper and lower cylinders that form the first and the second rotary compression elements without passing through the supporting members. In that case, however, since the distance between the upper and lower refrigerant introduction pipes is too close, it will cause a problem that a pressure resistance strength (8 MPaG) of the sealed container between the pipe connection portions cannot be maintained.

On the other hand, regarding the installation of the accumulator at the low pressure side of the refrigerant cycle, a refrigerant filling amount is required to be large. In addition, for preventing a liquid back flow phenomenon, the aperture of the throttling means is reduced, or the capacity of the accumulator has to be increased, which will cause a reduction of the cooling ability or an enlargement of the installation space.

In addition, since the compression ratio is very high and the temperature of the compressor itself and/or the temperature of the refrigerant gas discharged to the refrigerant cycle are high, it is very difficult that the evaporation temperature at the evaporator is below 0° C., for example, at an extreme low temperature range below 50° C.

SUMMARY OF THE INVENTION

According to the foregoing description, an object of this invention is to provide an internal intermediate pressure multistage compression type rotary compressor, wherein a pressure resistance strength of the sealed container between the refrigerant introduction pipes connected to the first and the second cylinder can be maintained, and the whole size of the compressor can be reduced.

Another object of this invention is to provide a cooling device, wherein the cooling ability of the evaporator can be increased, the damage due to the, liquid compression in the compressor can be prevented without arranging an accumulator at the low pressure side.

According to the objects mentioned above, The present invention provides a multistage compression type rotary compressor, having a driving element, and a first and a second rotary compression elements that are driven by the driving element in a sealed container, wherein a refrigerant compressed by the first rotary compression element is discharged into the sealed container, and said discharged refrigerant with an intermediate pressure is then compressed by the second rotary compression element. The multi-stage compression type rotary compressor comprises a first and a second cylinders, respectively forming the first and the second rotary compression elements; an intermediate partition plate, disposed between the first and the second cylinders for partitioning the first and the second rotary compression elements and for blocking an opening of the first and the second rotary compression elements; a first supporting member, for blocking another opening of the first cylinder, and used as a bearing for one end of a rotary shaft of the driving element; a second supporting member, for blocking another opening of the second cylinder, and used as a bearing for the other end of the rotary shaft of the driving element; a first refrigerant introduction pipe for introducing the refrigerant into an absorption side of the first rotary compression element, connected corresponding to the first cylinder; and a second refrigerant introduction pipe for introducing the refrigerant into an absorption side of the second rotary compression element, connected corresponding to the second supporting member.

The present invention further provides a multi-stage compression type rotary compressor, having a driving element and a first and a second rotary compression elements that are driven by the driving element in a sealed container, wherein a refrigerant compressed by the first rotary compression element is discharged into the sealed container, and said discharged refrigerant with an intermediate pressure is then compressed by the second rotary compression element. The multi-stage compression type rotary compressor comprises a first and a second cylinders, respectively forming the first and the second rotary compression elements; an intermediate partition plate, disposed between the first and the second cylinders for partitioning the first and the second rotary compression elements and for blocking an opening of the first and the second rotary compression elements; a first supporting member, for blocking another opening of the first cylinder, and used as a bearing for one end of a rotary shaft of the driving element; a second supporting member, for blocking another opening of the second cylinder, and used as a bearing for the other end of the rotary shaft of the driving element; a first refrigerant introduction pipe for introducing the refrigerant into an absorption side of the first rotary compression element, connected corresponding to the first supporting member; and a second refrigerant introduction pipe for introducing the refrigerant into an absorption side of the second rotary compression element, connected corresponding to the second cylinder.

In addition, the present invention also provides a cooling device wherein a compressor, a gas cooler, a throttling means and an evaporator are connected in serial, and the compressor comprises a first and a second rotary compression elements in a sealed container wherein a refrigerant compressed and discharged by the first rotary compression element is compressed by absorbing into the second rotary compression element, and is discharged to the gas cooler. The cooling device comprises an intermediate cooling circuit for radiating heat of the refrigerant discharged from the first rotary compression element, wherein at least one portion of the intermediate cooling circuit is arranged in locations where frosting and freezing occur. Therefore, because heat of the refrigerant that is compressed and discharged by the first rotary compression element is taken by passing through the locations that need to be prevented from frosting and freezing, the refrigerant temperature can be reduced.

In addition, because the locations that need to be prevented from frosting and freezing are heated by the refrigerant, the frosting and the freezing can be prevented in advance.

The above cooling device further comprises a heat insulation box, a storage compartment that is formed in the heat insulation box and cooled by the evaporator, and a cover for covering an opening of the heat insulation box. At least one portion of the intermediate cooling circuit is arranged at the opening of the heat insulation box. Because heat of the refrigerant that is compressed and discharged by the first rotary compression element is taken by passing through the opening of the heat insulation box, the refrigerant temperature can be reduced.

In addition, since the opening of the heat insulation box is heated by the refrigerant, the opening of the heat insulation box can be prevented from frosting and freezing in advance.

The cooling device further comprises an internal heat exchanger for performing a heat exchange between the refrigerant coming out of the gas cooler from the second rotary compressor and the refrigerant coming out of the evaporator. Because the heat exchange between the refrigerant coming out of the gas cooler from the second rotary compressor and the refrigerant coming out of the evaporator is performed to take heat away, the superheat degree can be maintained and the liquid compression in the compressor can be avoided.

In the above cooling device, an evaporation temperature of the refrigerant at the evaporator can be equal to or less than 0° C. It is very effective in an extremely low range equal to or less than −50° C., for example.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
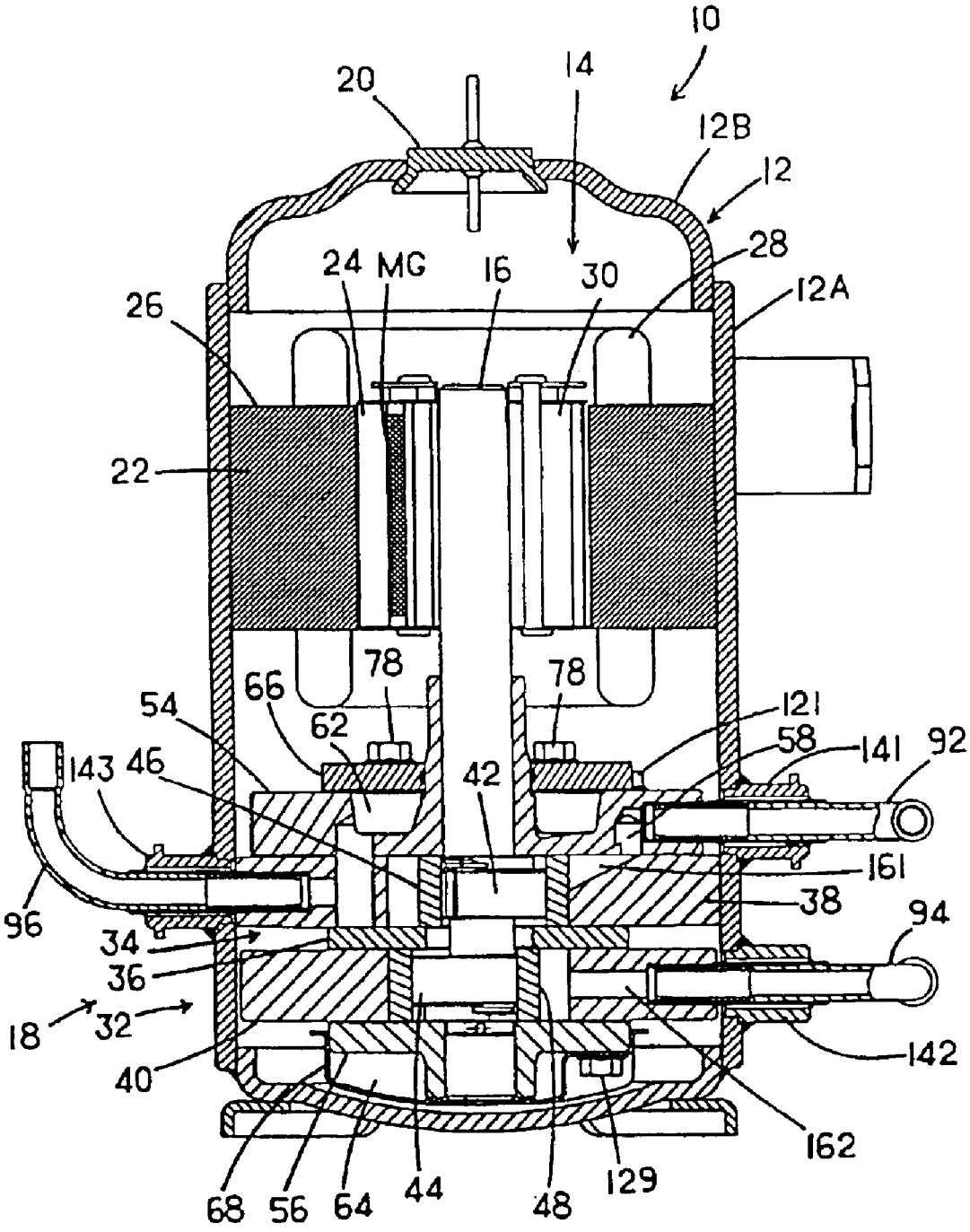
FIG. 1 is a vertically cross-sectional view of a rotary compressor according to one embodiment of the present invention.

The embodiments of the present invention are described in details according to the attached drawings. FIG. 1 is a vertical cross-sectional view of an internal intermediate pressure multistage (e.g., two stages) compression type rotary compressor having a first and a second rotary compression elements.

In the drawings, the internal intermediate pressure type multi-stage compression rotary compressor (rotary compressor, hereinafter) 10 uses carbon dioxide ($CO_2$) as the refrigerant. The rotary compressor 10 is constructed by a rotary compression mechanism 18, which comprises a sealed container 12, a first rotary compression element (the first stage) 32, and a second rotary compression element 34 (the second stage). The sealed container 12 is formed by circular steel plates. The driving element 14 is received at an upper part of an internal space of the sealed container 12. The first and the second rotary compression elements 32, 34 are arranged below the driving element 14, and are driven by a rotary shaft 16 of the driving element 14.

The sealed container 12 comprises a main container body 12A and an end cap 12B. The bottom part of the sealed container 12 serves as an oil accumulator, and the main container body 12A is used to contain the driving element 14 and the rotary compression mechanism. The end cap 12B is substantially bowl shape and is used for blocking an upper opening of the container main body 12A. A circular installation hole 12D is further formed in the center of the upper surface of the end cap 12B, and a terminal (wirings are omitted) 20 are installed onto the end cap 12B for providing power to the driving element 14.

The electrical motor element 14 is a DC (direct current) motor of a so-called magnetic-pole concentrated winding type, and comprises a stator 22 and a rotor 24. The stator 22 is annularly installed along an inner circumference of an upper space of the sealed container 12, and the rotor 24 is inserted into the stator 22 with a slight gap 3. The rotor 24 is affixed onto the rotational shaft 16 that passes the center and extends vertically. The stator 22 comprises a laminate 26 formed by doughnut-shaped electromagnetic steel plates and a stator coil 28 that is wound onto tooth parts of the laminate 26 in a series (concentrated) winding manner. Additionally, similar to the stator 22, the rotor 24 is also formed by a laminate 30 of electromagnetic steel plates, and a permanent magnet MG is inserted into the laminate 30.

An intermediate partition plate 36 is sandwiched between the first rotary compression element 32 and the second rotary compression element 34. Namely, the first rotary compression element (the second cylinder) 32 and the second rotary compression element (the first cylinder) 34 are constructed by the intermediate partition plate 36, an upper cylinders 38 and a lower cylinder 40, an upper and a lower roller 46, 48, an upper and a lower valves 50, 52, and an upper supporting member (the second supporting member) 54 and a lower supporting member (the first supporting member) 56. The upper and the lower cylinders 38, 40 are respectively arranged above and under the intermediate partition plate 36. The upper and the lower roller 46, 48 are eccentrically rotated by an upper and a lower eccentric parts 42, 44 that are set on the rotational shaft 16 with a phase difference of 180° in the upper and the lower cylinders 38, 40. The valves 50, 52 are in contact with the upper and the lower roller 46, 48 to divide the upper and the lower cylinders 38, 40 respectively into a low pressure chamber and a high pressure chamber. The upper and the lower supporting members 54, 56 are used to block an open surface at the upper side of the upper cylinder 38 and an open surface at the lower side of the lower cylinder 40, and are also used as a bearing of the rotational shaft 16.

In the rotary compressor, as described above, when a refrigerant with a large difference between the high pressure and the low pressure (e.g., $CO_2$) is used as the refrigerant, the interior of the sealed container 12 usually has an extreme high pressure higher than in an ordinary case. As the refrigerant introduction pipes 92, 94 (that will be described in detail below) are connected to portions corresponding to the upper and the lower cylinders 38, 40 in the sealed container 12, the distance between the refrigerant introduction pipes 92, 94 becomes shorter and the pressure resistance strength of the sealed container 12 between the refrigerant introduction pipes 92, 94 cannot be maintained. Therefore, the gap between the refrigerant introduction pipes 92, 94 is increased while the enlargement in the dimension of the compressor has to be prevented.

An absorption passage 58 for connecting the interior of the upper cylinder 38 by an absorption port 1621 formed in the upper cylinder 38 and a discharging muffler chamber 64 recessed away from the driving element 14 are formed in the upper supporting member 54. An opening of the discharging muffler chamber 62, which is opposite to the upper cylinder 38, is blocked by the upper cover 66.

In addition, an absorption port 162 for connecting the low pressure chamber side of the lower cylinder 40 is formed in the lower cylinder 40, and an opening at the lower side of the lower cylinder (an opening opposite to the intermediate partition plate 36) is blocked by the ordinary lower supporting member 56. The lower side of the lower supporting member 56 is covered by the bowl shaped ordinary muffler cover. The discharging muffler chamber 64 is formed between the muffler cover 68 and the lower supporting member 56.

The muffler cover 68 is fixed onto the lower supporting member 56 by screwing main bolts 129 from bottom to four locations at the circumference. The muffler cover 68 is used to block a lower opening of the discharging muffler chamber 64 that is connected to the interior of the lower cylinder 40 of the first rotary compression element 32 through a discharging port (not shown). The tips of the main bolts 129 are screwed to engage with the upper supporting member 54.

The driving element 14 sides of the upper cover 66 of the discharging muffler chamber 64 and the inner space of the sealed contained 12 are connected by a connection passage (not shown) that penetrates the upper and the lower cylinders 38, 40 and the intermediate partition plate 36. An intermediate discharging pipe 121 is formed by standing on the top end of the connection passage. The intermediate discharging pipe 121 is opened at the driving element 14 side of the upper cover 66 of the inner space of the sealed contained 12.

The upper cover 66 is used to block an upper opening of the discharging muffler chamber 62 that is connected to the interior of the upper cylinder 38 of the second rotary compression element 34. By using four main bolts 78, the peripheral of the upper cover 66 is fixed onto the top of the upper supporting member 54. The front ends of the main bolts 78 are screwed to the lower supporting member 56.

In consideration that the refrigerant is good for the earth environment, the combustibility and the toxicity, the refrigerant uses a nature refrigerant, i.e., the aforementioned carbon dioxide ($CO_2$). Regarding the oil, used as a lubricant oil sealed in the sealed container 12, the existing oil, for example, a mineral oil, an alkyl benzene oil, an ether oil, and a PAG (poly alkyl glycol) can be used.

On the side faces of the main body 12A of the sealed container 12, a sleeve 141 is fused to fix to a position corresponding to the absorption passage 58 of the upper supporting member 54, a sleeve 142 is fused to fix to a position corresponding to the absorption port 162 of the lower cylinder 40, and a sleeve 143 is fused to fix to a position corresponding to the upper cylinder 38. In this way, in comparison with that each of sleeves is installed corresponding to the upper and the lower cylinder 38, 40, the gap between the sleeves 141 and 142 becomes larger. As a result, the pressure resistance strength of the sealed container 12 between the sleeves 141 and 142 where the refrigerant introduction pipes 92, 94 are connected thereto can be maintained. In addition, the sleeve 143 is substantially positioned at a diagonal position with respective to the sleeve 141.

One end of the refrigerant introduction pipe (the second refrigerant introduction pipe) 92 for introducing the refrigerant gas to the upper cylinder 38 is inserted into the sleeve 141, and that end of the refrigerant introduction pipe 92 is connected to the absorption passage 58 of the upper cylinder 38. The refrigerant introduction pipe 92 passes through the upper side of the sealed container 12, and then reaches a sleeve (not shown) that is located at a position separated from the sleeve 141 by about 90 degree. The other end of the refrigerant introduction pipe 92 is inserted into the sleeve and then connected to the interior of the sealed container 12.

In addition, one end of the refrigerant introduction pipe (the first refrigerant introduction pipe) 94 for introducing the refrigerant gas to the lower cylinder 40 is inserted into the sleeve 142, and that end of the refrigerant introduction pipe 92 is connected to the absorption port 162 formed in the lower cylinder 40. In addition, the refrigerant discharging pipe 96 is inserted to connect into the sleeve 143, and that end of the refrigerant discharging pipe 96 passes through the interior of the upper cylinder 38, and then connected to the discharging muffler chamber 62 in the upper supporting member 54.

As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which is absorbed from the absorption port 162 into the low pressure chamber of the lower cylinder 40 through the refrigerant pipe 94, is compressed due to the operation of the roller 48 and the valve, and then becomes intermediate pressure status. Thereafter, starting from the high-pressure chamber of the lower cylinder 40, the intermediate pressure refrigerant gas passes through a connection passage from the discharging muffler chamber 64 formed in the lower supporting member 56, and then discharges from the intermediate discharging pipe 121 into the sealed container 12. Then, the interior of the sealed container 12 becomes intermediate pressure status (8 MPaG).

Then, the intermediate pressure refrigerant gas in the sealed container 12 flows out of a sleeve (not shown), and passes through an absorption passage 58 formed in the refrigerant introduction pipe 92 and the upper supporting member 54. Then, the refrigerant gas is absorbed from an absorption port 161 into the low pressure chamber side of the upper cylinder 38. By an operation of roller and valve, the second stage compression is performed and thus the absorbed intermediate pressure refrigerant gas becomes a high temperature and high pressure refrigerant gas (12 MPaG). Thereafter, the high temperature and high pressure refrigerant gas flows to the discharging port from the high pressure chamber side, passes through the discharging muffler chamber 62 formed in the upper supporting member 54, the upper cylinder 38 and the refrigerant discharging pipe 96, and then flows into an exterior gas cooler.

After the refrigerant flowing to the gas cooler exchanges heat at the gas cooler to heat the air or water, etc., the refrigerant passes through an expansion valve and then flows into an evaporator (not shown) at which the refrigerant evaporates. Then, the refrigerant is absorbed from the refrigerant introduction pipe 94 into the first rotary compression element 32. The aforementioned cycle is repeatedly conducted.

As described above, since the refrigerant introduction pipe 94 for introducing the refrigerant to the absorption side of the first rotary compression element 32 is connected corresponding to the lower cylinder 40 and the refrigerant introduction pipe 92 for introducing the refrigerant to the absorption side of the second rotary compression element 34 is connected corresponding to the upper supporting member 54, the gap between the refrigerant introduction pipes 92, 94 connected to the upper and the lower cylinders 38, 40 is enlarged, so that the pressure resistance strength of the sealed container 12 can be maintained. Furthermore, the refrigerant introduction pipes 92, 94 are connected corresponding to the upper and the lower supporting members 54, 40, and the entire dimension of the rotary compressor 10 can be reduced since the dimension of the rotary compression mechanism section is reduced.

In this manner, a light weight of the rotary compressor 10 can be achieved, which is advantageous for handling, transportation and installation, etc., of the rotary compressor 10. Moreover, since the refrigerant introduction pipe 94 is connected corresponding to the lower cylinder 40, ordinary parts can be also used as the first supporting member 56 and the muffler cover 68, so as to expand its generality. Therefore, the structure of the rotary compressor 10 can be simplified, and the manufacturing cost can be substantially suppressed.

Figure 2:
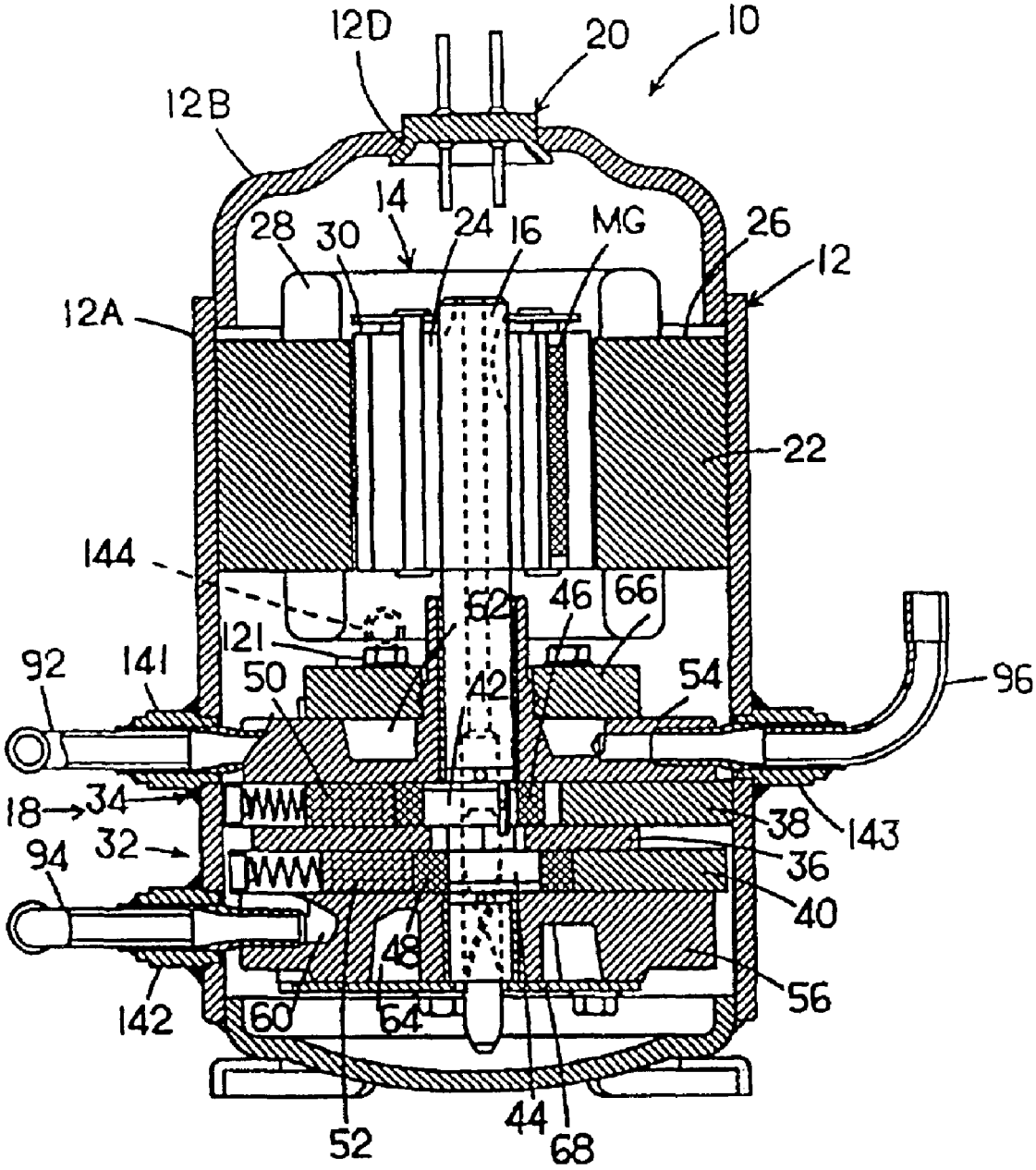
FIG. 2 is a vertically cross-sectional view of a multi-stage compression type rotary compressor according to another embodiment of the present invention.
Figure 3:
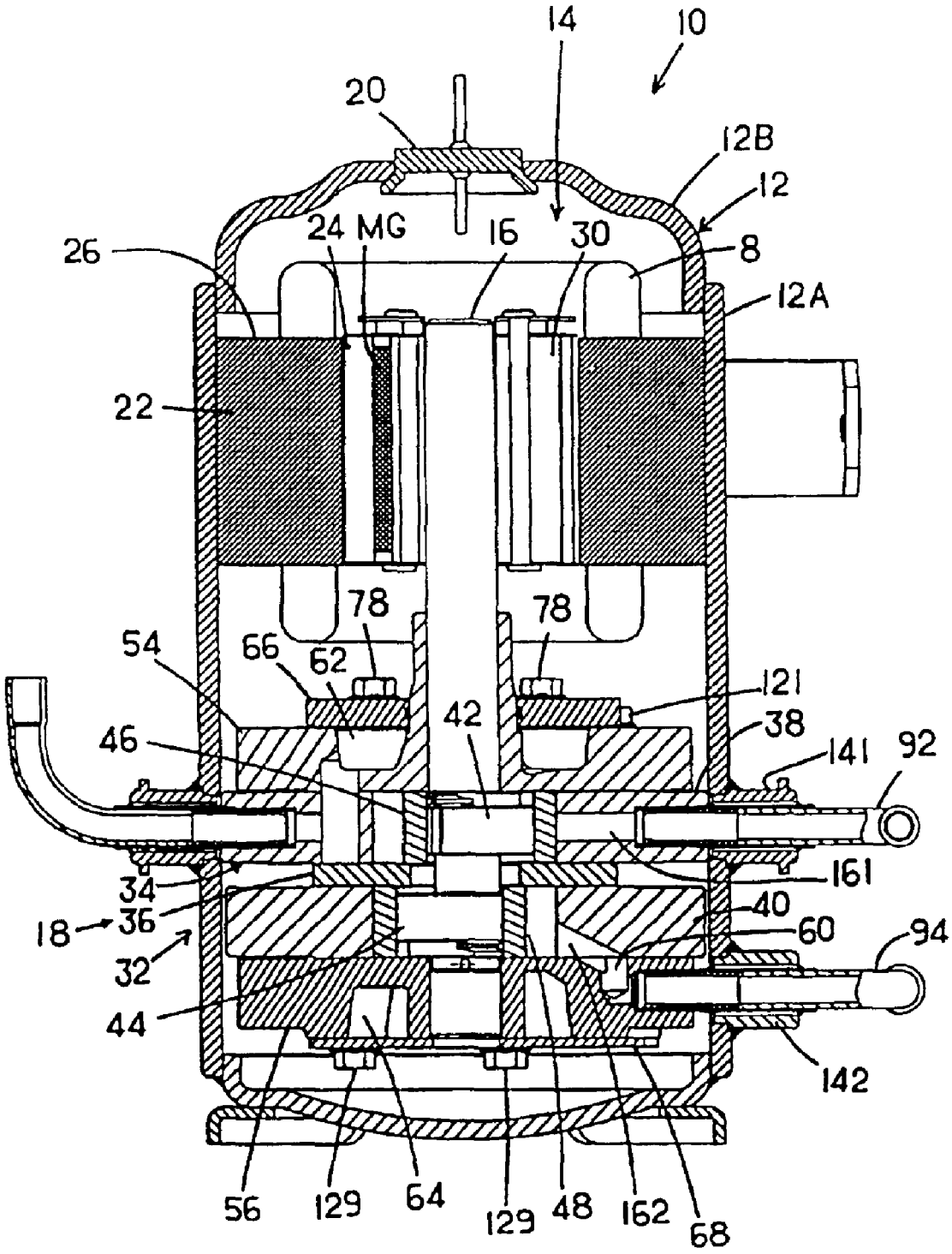
FIG. 3 is a vertically cross-sectional view of a rotary compressor according to another embodiment of the present invention.

FIG. 3 shows another exemplary rotary compressor according to the embodiment of the present invention. In addition, in FIG. 3, numerals as the same as those in FIGS. 1 and 2 can achieve the same or similar functions.

Referring to FIG. 3, the absorption port 161 for connecting the lower pressure chamber side of the upper cylinder 38 is formed on the upper cylinder 38 of the rotary compressor 10. The upper opening of the upper cylinder 38 (the opening opposite to the intermediate partition plate 36) is covered by the upper supporting member 54. The discharging muffler chamber 64 recessed from the driving element 14 is formed in the upper supporting member 54, and the upper opening of the discharging muffler chamber 62 is blocked by the upper cover 66.

An absorption passage 60 for connecting the interior of the lower cylinder 40 by an absorption port 162 formed in the lower cylinder 40 and a discharging muffler chamber 64 recessed towards the driving element 14 are formed in the lower supporting member 56. Also, an opening of the discharging muffler chamber 64, which is opposite to the upper cylinder 38, is blocked by the lower cover 68. Then, the sleeve 141 and the refrigerant introduction pipe 92 are connected corresponding to the absorption port 161 of the upper cylinder 38, and the sleeve 142 and the refrigerant introduction pipe 94 are connected corresponding to the absorption passage 60 that connects the interior of the lower cylinder 40.

The other operation is similar to the structure shown in FIG. 1. Since the refrigerant introduction pipes 92, 94 are vertically arranged to possess a larger gap between them, the pressure resistance strength of the sealed container 12 between the refrigerant introduction pipes 92, 94 can be maintained.

As described, in the structure shown in FIG. 3, the refrigerant introduction pipe 94 for introducing the refrigerant to the absorption side of the first rotary compression element 32 is connected corresponding to the lower supporting member 56, and the refrigerant introduction pipe 92 for introducing the refrigerant to the absorption side of the second rotary compression element 34 is connected corresponding to the upper cylinder 38. Therefore, the entire dimension of the rotary compressor 10 can be reduced, while the pressure resistance strength of the sealed container 12 between the refrigerant introduction pipes 92, 94 is maintained.

Figure 4:
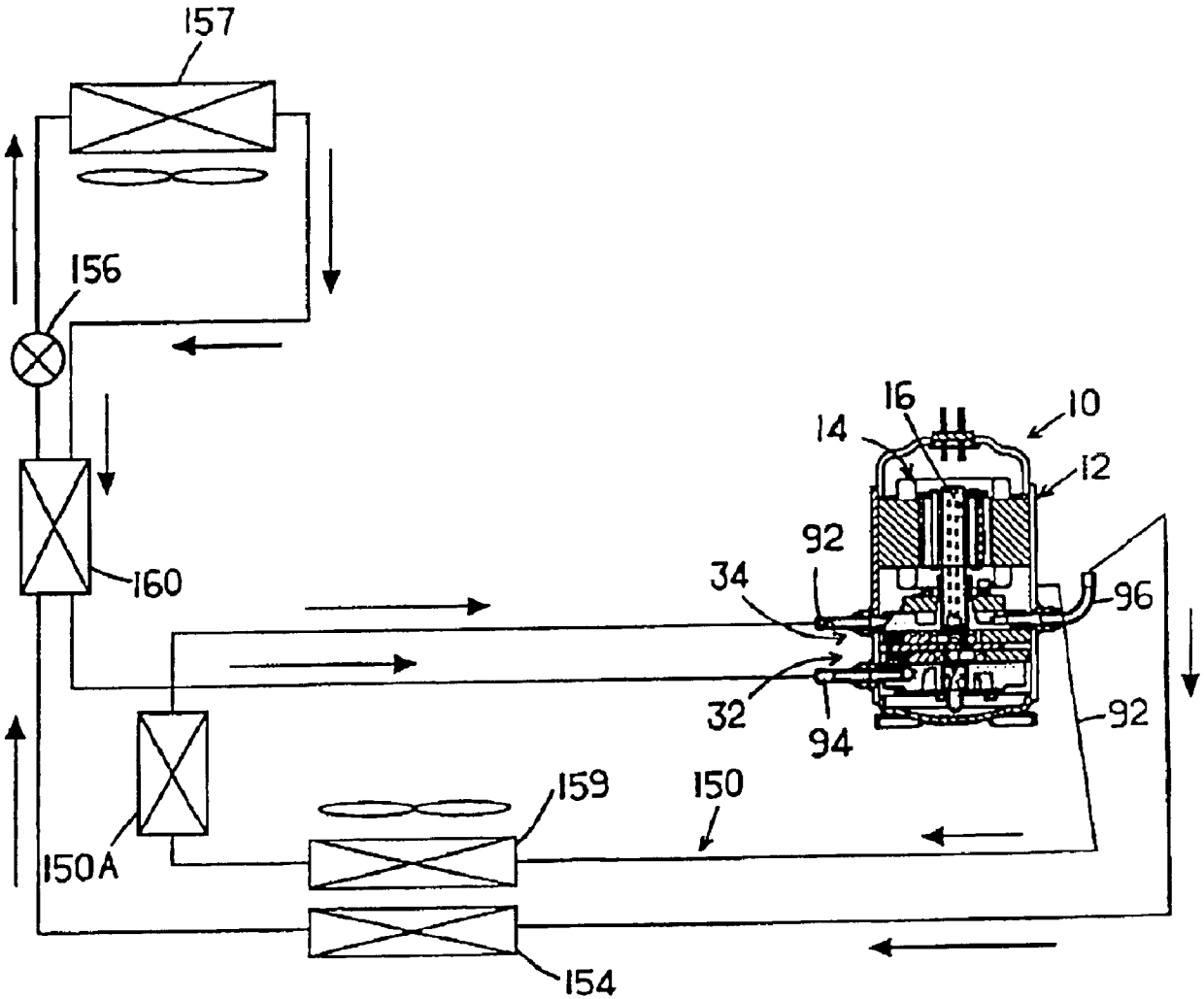
FIG. 4 is a refrigerant circuit of a cooling device according to the invention.

Additionally, according to the embodiment of the invention, a rotary compressor 10 using CO2 as the refrigerant is described, but the present invention is not limited to such a configuration. For example, the disclosure of the present invention is also suitable for a multi-stage compression type rotary compressor that uses a refrigerant other than $CO_2$ if the refrigerant has a large difference between the high and the low pressures In FIG. 4, after a portion of pipe passes through the intermediate heat exchanger 159, the portion of pipe of the intermediate cooling circuit 150 is arranged to pass through a frame pipe (a frame heater) 150A, which is formed in the opening 202 of the heat insulation box 201 and used for radiating heat.

Figure 5:
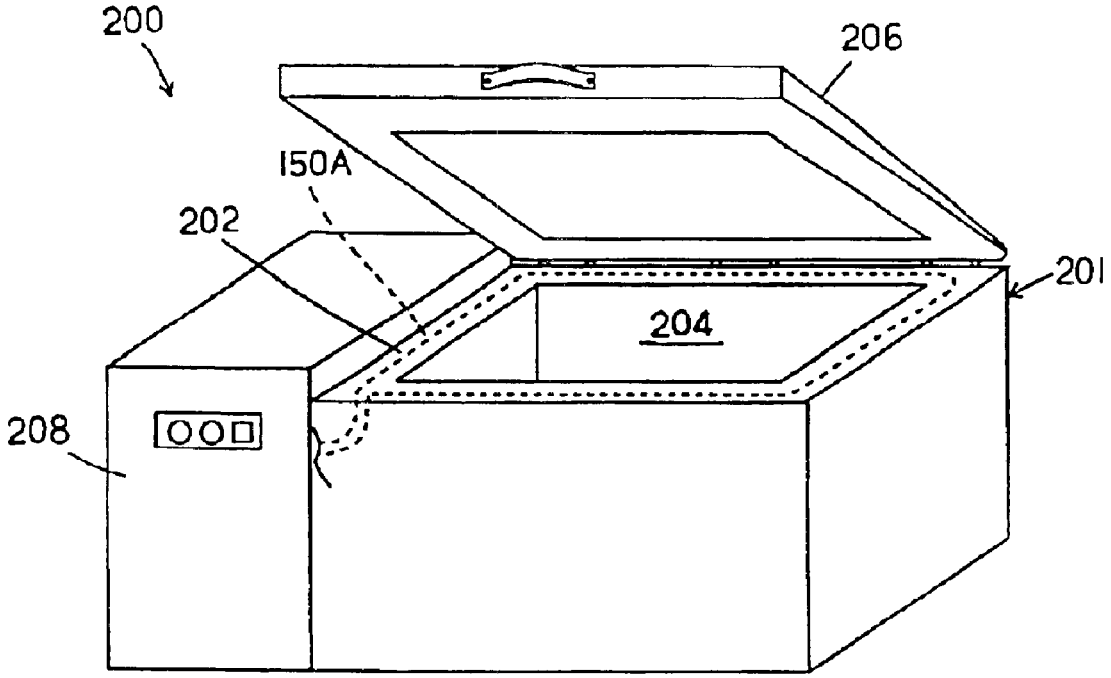
FIG. 5 is a perspective view of the cooling device of the present invention.

FIG. 5 is a perspective view of a cooling device according to the embodiment of the present invention. In FIG. 5, the cooling device 200 is a freezer used for physical and chemical experiments, etc., and has the aforementioned heat insulation box 201. The heat insulation box 201 comprises a metal inner box and an external box (not shown), and heat insulating material is filled between the inner box and the external box. In addition, the aforementioned evaporator 157 is arranged at the heat insulating material side (the outer surface) of the inner box of the heat insulation box 201. A storage compartment 204, which is cooled by the evaporator 157, is constructed in the inner box of the heat insulation box 201. The heat insulation box 201 is constructed in a structure where an opening 202 can be openably blocked by a cover 206. In addition, a frame pipe 150A, which is arranged by burying a portion pipe of the intermediate cooling circuit 150, is constructed along the entire circumference of the opening 202 of the heat insulation box 201.

The frame pipe 150A is used to take away heat from the refrigerant that passes through the frame pipe 150A, and to heat the opening 202 and its ambient portion, so as to prevent occurrences of frosting and freezing. In addition, in FIG. 3, a mechanical room is arranged to contain the compressor 10, the gas cooler 154, the internal heat exchanger 160, the expansion valve 156 and the intermediate heat exchanger 159.

The operation of the aforementioned cooling device 200 in FIG. 5 according to the present invention is described. As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port into the low pressure chamber of the lower cylinder 40, is compressed due to the operation of the roller 48 and the valve 52, and then becomes intermediate pressure. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior of the sealed container 12 becomes intermediate pressure.

The intermediate pressure refrigerant gas inside the sealed container 12 enters the refrigerant inlet pipe 92, releases from the sleeve 144, and then flows into the intermediate cooling circuit 150. In the process where the intermediate cooling circuit 150 passes through the gas cooler 154, heat is radiated in an air cooling manner. Afterwards, the refrigerant passes through the frame pipe 150A that is buried across the entire circumference of the opening 202 of the cooling device 200. Then, heat of the refrigerant is taken away by the cold air around the opening 202, and the refrigerant is further cooled.

On the other hand, the opening 202 of the cooling device 200 is heated by the intermediate pressure refrigerant, and occurrences of frosting and freezing can be prevented in advance. In this manner, by making the intermediate pressure refrigerant gas, which is compressed by the first rotary compression element 32, to pass through the intermediate cooling circuit 150, since the frame pipe 150A formed in the opening 202 and the intermediate heat exchanger 159 can achieve a cooling operation effectively, the temperature in the sealed container 12 can be suppressed from rising. As a result, the compression efficiency of the second rotary compression element 34 can be improved. In addition, by cooling the refrigerant that is subsequently absorbed into the second rotary compression element 34, the rise in the temperature of the refrigerant that is compressed by and discharged from the second rotary compression element 34 can be prevented.

Moreover, the refrigerant can be cooled in two stages of the intermediate heat exchanger 159 and the opening 202 where the frame pipe 150A passes through, so that it is not necessary to increase the capacity of the intermediate heat exchanger 159. Therefore, the mechanical room 208 of the cooling device 200 can be more compact.

Then, the cooled intermediate pressure refrigerant gas passes through the absorption passage (not shown) formed in the upper supporting member 54, and then is absorbed from the absorption port (not shown) into the low pressure chamber of the upper cylinder 38 of the second rotary compression element 34. By the operation of the roller 46 and the valve 50, the second stage compression is performed to form high pressure and high temperature refrigerant. Then, the high pressure and high temperature refrigerant flows to the discharging port (not shown) from the high pressure chamber side, passes through the discharging muffler chamber 62 formed in the upper supporting member 54, and then is discharged from the refrigerant discharging pipe 96 to the external.

The refrigerant gas discharged from the refrigerant discharging pipe 96 flows into the gas cooler 154 at which the refrigerant gas radiates heat in an air cooling manner. Then, the refrigerant gas passes through the internal heat exchanger 160 where heat of the refrigerant is taken by the refrigerant at the low-pressure side to be further cooled.

Due to the existence of the internal heat exchanger 160, because heat of the refrigerant that comes out the gas cooler 154 and passes through the internal heat exchanger 160 is taken by the refrigerant at the low pressure side, the supercooling degree of the refrigerant is increased. Therefore, the cooling ability at the evaporator 157 is improved.

The high pressure side refrigerant gas that is cooled by the internal heat exchanger 160 reaches the expansion valve 156. The refrigerant gas is depressurized at the expansion valve 156, and then flows into the evaporator 157 where the refrigerant evaporates to perform a heat absorption to cool the inner box of the heat insulation box 201. In this way, the storage compartment 204 is cooled from the walls of the inner box.

At this time, by an effect of making the intermediate pressure refrigerant gas compressed by the first rotary compression element 32 to pass through the intermediate cooling circuit 150 so as to suppress the rising temperature of the interior of the sealed container and the refrigerant in the second rotary compression element 34, and an effect of making refrigerant gas compressed by the second rotary compression element 32 to pass through the internal heat exchanger to increase the supercooling degree of the refrigerant before reaching the expansion valve 156, and the cooling ability of the refrigerant at the evaporator 157.

Namely, in this case, the evaporation temperature at the evaporator 154 can easily reach a temperature range equal to or below 0° C., for example, an extreme low temperature range equal to or less than 50° C. In addition, the power consumption of the compressor 10 can also be reduced.

Thereafter, the refrigerant flows out of the evaporator 157, and then reaches the internal heat exchanger 160 where heat is taken from the high pressure side refrigerant gas to obtain a heating effect.

In this manner, the refrigerant coming out of the evaporator 157 can be exactly gasified. In particular, even though redundant refrigerant occurs due to a certain operation condition, since the low pressure side refrigerant is heated by the internal heat exchanger 160, the liquid back flow phenomenon that the liquid refrigerant is absorbed into the compressor 10 can be exactly prevented without installing an accumulator at the low pressure side. Therefore, a disadvantage of compressor damages caused by the liquid compression can be avoided.

In addition, by making a cycle without increasing the discharging temperature and the internal temperature of the compressor 10, the reliability of the cooling device 200 can be improved.

The refrigerant heated by the internal heat exchanger 160 is absorbed from the refrigerant introduction pipe 94 into the first rotary compression element 32 of the compressor 10, and that process is repeatedly processed.

As described, according to the present invention, the intermediate cooling circuit 150 for radiating heat of the refrigerant that is discharged from the first rotary compression element 32 is equipped and a portion of the pipe of the intermediate cooling pipe 150 is arranged in the opening 202 of the heat insulation box 201 to form the frame pipe 150A. Furthermore, by passing through the frame pipe 150A arranged in the opening 202 of the heat insulation box 201, heat of the refrigerant that is compressed and discharged by the first rotary compression element is taken. Therefore, the temperature of the refrigerant can be decreased.

In this manner, the compression efficiency of the second rotary compression element 34 can be improved. Furthermore, because the refrigerant absorbed into the second rotary compression element 34 is cooled, the temperature of the refrigerant that is compressed and discharged by the second rotary compression element 34 can be prevented from rising.

On the other hand, locations in the cooling device 200 that need to be prevented from being frosted or frozen by the refrigerant are heated to prevent freezing or frosting the cooling device 200 in advance.

In addition, the internal heat exchanger 160 for performing the heat exchanger between the refrigerant flowing out of the gas cooler 154 from the second rotary compression element 34 and the refrigerant flowing out of the evaporator 157 is equipped, so that the refrigerant flowing out of the evaporator 157exchanges heat with the refrigerant flowing out of the gas cooler 154 from the second rotary compression element 34 to take heat. Therefore, the superheat degree of the refrigerant can be exactly maintained and the liquid compression in the compressor 10 can be avoided.

Moreover, since heat of the refrigerant flowing out of the gas cooler 154 from the second rotary compression element 34 is taken by the refrigerant flowing out of the evaporator 157 at the internal heat exchanger 160, the supercooling degree of the refrigerant before reaching the expansion valve 156 is increased. Therefore, the cooling ability of the evaporator 157 can be further improved.

Accordingly, the evaporation temperature of the refrigerant at the evaporator 157 of the refrigerant cycling device can be reduced. For example, the evaporation temperature at the evaporator 157 can easily reach an extremely low temperature range, e.g. equal to or less than 50° C. In addition, the power consumption of the compressor 10 can also be reduced.

In the embodiment of the present invention, the frame pipe 150A is arranged at the downstream side of the intermediate heat exchanger 159 of the intermediate cooling circuit 150. However, the frame pipe 150A can also be arranged at the upstream side of the intermediate heat exchanger 159.

In addition, according to the embodiment of the present invention, the evaporator 157 is arranged at the heat insulation material side (outer surface) of the inner box of the heat insulation box 201, the storage compartment 204 is cooled from the walls of the inner box by cooling the inner box. However, the location of the evaporator and the cooling method are not particularly limited. For example, various methods, such as using a fan to enforce the cold air to circulate to cool the storage compartment, can be also used.

In the embodiment, carbon dioxide is used as the refrigerant, but that is not used to limit the scope of the present invention. For example, other refrigerants, such as refrigerants of fluorine system or carbon hydroxide system can be also used.

As described above, the gap between the first and the second refrigerant introduction pipes for introducing the refrigerant into the first and the second cylinder can be maintained, and the pressure resistance strength of the sealed container between the two refrigerant introduction pipes can be maintained. In this case, the first refrigerant introduction pipe is connected corresponding to the first cylinder in one embodiment, and the second refrigerant introduction pipe is connected corresponding to the second cylinder in another embodiment. Therefore, as comparing with the case that the first and the second refrigerant introduction pipes are connected corresponding to the first and the second supporting members, the entire dimension of the fist and the second rotary compression element can be prevented from getting large and the compressor itself can become smaller and more compact.

In particular, an ordinary part of the rotary compressor can be also used as the first supporting member, so that the present invention features of generality.

According to the cooling device of the invention, the compressor comprises a driving element, a first and a second rotary compression elements both of which are driven by the driving element in a sealed container. The refrigerant compressed and discharged by the first rotary compression element is compressed by absorbing into the second rotary compression element, and is discharged to the gas cooler. The cooling device comprises an intermediate cooling circuit for radiating heat of the refrigerant discharged from the first rotary compression element, wherein at least one portion of the intermediate cooling circuit is arranged in locations where frosting and freezing occur. Therefore, because heat of the refrigerant that is compressed and discharged by the first rotary compression element is taken by passing through the locations that need to be prevented from frosting and freezing, the refrigerant temperature can be reduced.

In this way, the compression efficiency of the second rotary compression element can be improved. In addition, by cooling the refrigerant that is absorbed into the second rotary compression element 34, the rise in the temperature of the refrigerant that is compressed by and discharged from the second rotary compression element 34 can be suppressed. Further, since the supercooling degree of the refrigerant before the expansion valve is increased, the cooling ability at the evaporator is improved.

On the other hand, because the locations that need to be prevented from frosting and freezing are heated by the refrigerant, the frosting and the freezing can be prevented in advance.

The above cooling device further comprises a heat insulation box, a storage compartment that is formed in the heat insulation box and cooled by the evaporator, and a cover for covering an opening of the heat insulation box. At least one portion of the intermediate cooling circuit is arranged at the opening of the heat insulation box. Because heat of the refrigerant that is compressed and discharged by the first rotary compression element is taken by passing it through the opening of the heat insulation box, the refrigerant temperature can be reduced.

In this way, the compression efficiency of the second rotary compression element can be improved. In addition, by cooling the refrigerant absorbed into the second rotary compression element, the rise in the temperature of the refrigerant that is compressed and discharged by the second rotary compression element can be suppressed. In addition, since the supercooling degree of the refrigerant increases before reaching the expansion valve, the cooling ability of the evaporator is improved.

In addition, since the opening of the heat insulation box is heated by the refrigerant, the opening of the heat insulation box can be prevented from frosting and freezing in advance.

The cooling device further comprises an internal heat exchanger for performing a heat exchange between the refrigerant flowing out of the gas cooler from the second rotary compressor and the refrigerant flowing out of the evaporator. Because the heat exchange between the refrigerant flowing out of the gas cooler from the second rotary compressor and the refrigerant flowing out of the evaporator is performed to take heat away, the superheat degree can be maintained and the liquid compression in the compressor can be avoided.

In addition, since heat of the refrigerant flowing out of the gas cooler from the second rotary compressor is taken by the refrigerant flowing out of the evaporator, the supercooling degree of the refrigerant increases and therefore, the cooling ability of the refrigerant gas at the evaporator is improved.

Therefore, the desired cooling ability can be easily achieved without increasing the refrigerant cycling amount. Furthermore, the power consumption of the compressor can be also reduced.

In the above cooling device, an evaporation temperature of the refrigerant at the evaporator can be equal to or less than 0° C. It is very effective in an extremely low range equal to or less than −50° C., for example.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A multi-stage compression type rotary compressor, having a driving element and a first and a second rotary compression elements that are driven by the driving element in a sealed container, wherein a refrigerant compressed by the first rotary compression element is discharged into the sealed container, and said discharged refrigerant with an intermediate pressure is then compressed by the second rotary compression element, the multi-stage compression type rotary compressor comprising:

a first and a second cylinders, respectively forming the first and the second rotary compression elements;

an intermediate partition plate, disposed between the first and the second cylinders for partitioning the first and the second rotary compression elements and for blocking an opening of the first and the second rotary compression elements;

a first supporting member, for blocking another opening of the first cylinder, and used as a bearing for one end of a rotary shaft of the driving element;

a second supporting member, for blocking another opening of the second cylinder, and used as a bearing for the other end of the rotary shaft of the driving element;

a first refrigerant introduction pipe for introducing the refrigerant into an absorption side of the first rotary compression element, connected corresponding to the first cylinder; and a second refrigerant introduction pipe for introducing the refrigerant into an absorption side of the second rotary compression element, connected corresponding to the second supporting member.

2. A multi-stage compression type rotary compressor, having a driving element and a first and a second rotary compression elements that are driven by the driving element in a sealed container, wherein a refrigerant compressed by the first rotary compression element is discharged into the sealed container, and said discharged refrigerant with an intermediate pressure is then compressed by the second rotary compression element, the multi-stage compression type rotary compressor comprising:

a first and a second cylinders, respectively forming the first and the second rotary compression elements;

an intermediate partition plate, disposed between the first and the second cylinders for partitioning the first and the second rotary compression elements and for blocking an opening of the first and the second rotary compression elements;

a first supporting member, for blocking another opening of the first cylinder, and used as a bearing for one end of a rotary shaft of the driving element;

a second supporting member, for blocking another opening of the second cylinder, and used as a bearing for the other end of the rotary shaft of the driving element;

a first refrigerant introduction pipe for introducing the refrigerant into an absorption side of the first rotary compression element, connected corresponding to the first supporting member; and a second refrigerant introduction pipe for introducing the refrigerant into an absorption side of the second rotary compression element, connected corresponding to the second cylinder.

* * * * *